US009637986B2

(12) United States Patent
Frisby et al.

(10) Patent No.: US 9,637,986 B2
(45) Date of Patent: May 2, 2017

(54) TEMPERATURE COMPENSATED ELEMENT AND ASSOCIATED METHODS

(71) Applicant: TAM INTERNATIONAL, INC., Houston, TX (US)

(72) Inventors: Ray Frisby, Houston, TX (US); Arthur Loginov, Houston, TX (US); Iain Greenan, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 159 days.

(21) Appl. No.: 14/601,077

(22) Filed: Jan. 20, 2015

(65) Prior Publication Data

US 2015/0204158 A1 Jul. 23, 2015

Related U.S. Application Data

(63) Continuation-in-part of application No. 14/337,892, filed on Jul. 22, 2014.

(60) Provisional application No. 61/857,092, filed on Jul. 22, 2013.

(51) Int. Cl.

| | |
|---|---|
| ***E21B 23/06*** | (2006.01) |
| ***E21B 29/02*** | (2006.01) |
| ***E21B 33/128*** | (2006.01) |
| ***E21B 23/04*** | (2006.01) |
| ***E21B 33/12*** | (2006.01) |

(52) U.S. Cl.
CPC ..... *E21B 23/06* (2013.01); *E21B 23/04* (2013.01); *E21B 33/1208* (2013.01); *E21B 33/1285* (2013.01)

(58) Field of Classification Search
CPC ..... E21B 23/06; E21B 29/02; E21B 33/12; E21B 33/126; E21B 33/128; E21B 33/1285
See application file for complete search history.

(56) References Cited

U.S. PATENT DOCUMENTS 3,716,101 A * 2/1973 McGowen, Jr. ..... E21B 36/04 166/120
7,669,661 B2 * 3/2010 Johnson ..... E21B 23/04 166/373

* cited by examiner

*Primary Examiner* — Catherine Loikith
(74) *Attorney, Agent, or Firm* — Adolph Locklar

(57) ABSTRACT

A temperature actuated element includes a mandrel, a housing coupled to the mandrel, the housing defining a fluid expansion chamber. A piston is positioned within the fluid expansion chamber. A thermally expanding fluid is positioned within the fluid expansion chamber. An end ring coupled to the piston slides along the mandrel in response to a sliding of the piston. A degradable ring is coupled to the mandrel to prevent movement of the end ring before the degradable ring is dissolved. A packer having a first end and a second end, the first end adapted to slide along the mandrel in response to a sliding of the end ring, and the second end fixedly coupled to the mandrel, so that a sliding of the first end of the packer toward the second end causes the packer element to decrease in length and increase in radius.

20 Claims, 3 Drawing Sheets

TEMPERATURE COMPENSATED ELEMENT AND ASSOCIATED METHODS

CROSS-REFERENCE TO RELATED APPLICATIONS

This application is a continuation in part of U.S. application Ser. No. 14/337,892, a non-provisional application which claims priority from U.S. provisional application No. 61/857,092, filed Jul. 22, 2013. The entirety of U.S. application Ser. No. 14/337,892 is hereby incorporated by reference in its entirety.

TECHNICAL FIELD/FIELD OF THE DISCLOSURE

The present disclosure relates to downhole tools for forming a well seal in an annulus between an inner tubular and either an outer tubular or a borehole wall, or forming a plug with the outer tubular or borehole wall.

BACKGROUND OF THE DISCLOSURE

Swellable packers are isolation devices used in a downhole wellbore to seal the inside of the wellbore or a downhole tubular that rely on elastomers to expand and form an annular seal when immersed in certain wellbore fluids. Typically, elastomers used in swellable packers are either oil- or water-sensitive. Various types of swellable packers have been devised, including packers that are fixed to the OD of a tubular and the elastomer formed by wrapped layers, and designs wherein the swellable packer is slipped over the tubular and locked in place.

SUMMARY

The present disclosure provides for a temperature compensated element. The temperature compensated element may include a mandrel. The mandrel may be generally tubular and may have a central axis and an exterior cylindrical surface. The temperature compensated element may further include a housing coupled to the mandrel. The housing may define a fluid expansion chamber between an inner wall of the housing and the exterior cylindrical surface of the mandrel. The temperature compensated element may further include a piston positioned about the mandrel. The piston may have a piston head positioned within the fluid expansion chamber and adapted to slide along the mandrel. The piston head may form a seal against the housing and the mandrel to enclose the fluid expansion chamber. The temperature compensated element may further include a thermally expanding fluid positioned within the fluid expansion chamber. The temperature compensated element may further include an end ring positioned about the mandrel. The end ring may be coupled to the piston. The end ring may be adapted to slide along the mandrel in response to a sliding of the piston. The temperature compensated element may further include a degradable ring coupled to the mandrel. The degradable ring may be positioned adjacent to the end ring and adapted to prevent sliding of the end ring before the degradable ring has at least partially dissolved. The temperature compensated element may further include a packer including a packer element coupled to the exterior cylindrical surface of the mandrel. The packer may have a first end and a second end. The first end may be adapted to slide along the mandrel in response to a sliding of the end ring. The second end may be fixedly coupled to the mandrel, so that a sliding of the first end of the packer toward the second end causes the packer element to decrease in length and increase in radius.

The present disclosure also provides for a method of isolating a section of wellbore. The method may include providing a temperature compensated element. The temperature compensated element may include a mandrel. The mandrel may be generally tubular and may have a central axis and an exterior cylindrical surface. The temperature compensated element may further include a housing coupled to the mandrel. The housing may define a fluid expansion chamber between an inner wall of the housing and the exterior cylindrical surface of the mandrel. The temperature compensated element may further include a piston positioned about the mandrel. The piston may have a piston head positioned within the fluid expansion chamber and adapted to slide along the mandrel. The piston head may form a seal against the housing and the mandrel to enclose the fluid expansion chamber. The temperature compensated element may further include a thermally expanding fluid positioned within the fluid expansion chamber. The temperature compensated element may further include an end ring positioned about the mandrel. The end ring may be coupled to the piston. The end ring may be adapted to slide along the mandrel in response to a sliding of the piston. The temperature compensated element may further include a degradable ring coupled to the mandrel. The degradable ring may be positioned adjacent to the end ring and adapted to prevent sliding of the end ring before the degradable ring has at least partially dissolved. The temperature compensated element may further include a packer including a packer element coupled to the exterior cylindrical surface of the mandrel. The packer may have a first end and a second end. The first end may be adapted to slide along the mandrel in response to a sliding of the end ring. The second end may be fixedly coupled to the mandrel. The method may further include coupling the temperature compensated element to a downhole tubular assembly, running the downhole tubular assembly into a wellbore, and heating the downhole tubular assembly. The method may also include dissolving the degradable ring. The method may further include expanding the thermally expanding fluid, causing the piston, end ring, and first end of the packer to move along mandrel so that the packer element decreases in length and increases in radius, defining an actuated position. The method may further include contacting the wellbore with the outer surface of the packer.

The present disclosure also provides for a delayed compensation element. The delayed compensation element may include a mandrel. The mandrel may be generally tubular and may have a central axis and an exterior cylindrical surface. The delayed compensation element may further include a housing coupled to the mandrel. The delayed compensation element may further include an end ring positioned about the mandrel. The end ring may be adapted to slide along the mandrel. The delayed compensation element may further include a spring positioned between the housing and the end ring. The spring may be adapted to force the end ring away from the housing. The delayed compensation element may further include a degradable ring coupled to the mandrel. The degradable ring may be positioned adjacent to the end ring and adapted to prevent sliding of the end ring before the degradable ring has at least partially dissolved. The delayed compensation element may further include a packer including a packer element coupled to the exterior cylindrical surface of the mandrel. The packer may have a first end and a second end. The first end may be adapted to slide along the mandrel in response to a sliding of the end ring. The second end may be fixedly coupled to the mandrel, so that a sliding of the first end of the packer toward the second end causes the packer element to decrease in length and increase in radius.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
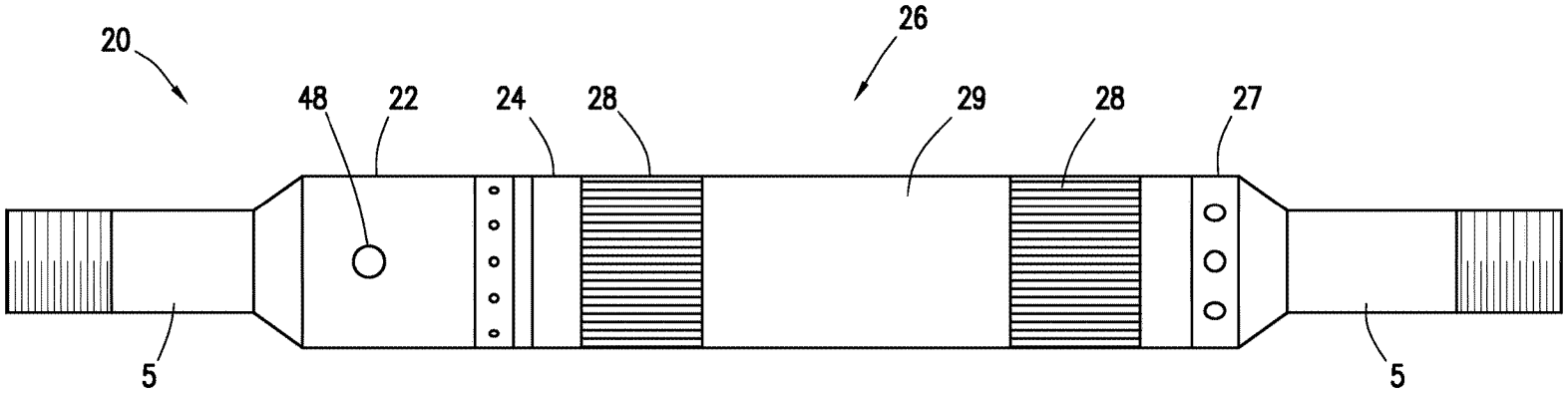
FIG. 1 is an elevation view of a temperature compensated element in a run in configuration consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
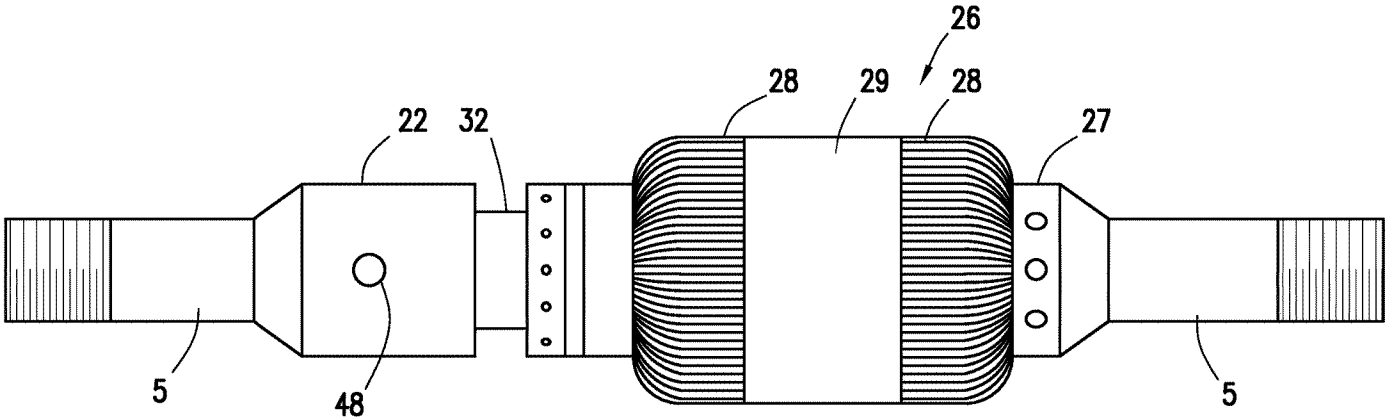
FIG. 2 is an elevation view of the temperature compensated element of FIG. 1 in an actuated configuration.

FIGS. 1 and 2 illustrate one embodiment of a temperature compensated element 20 for positioning downhole in a well to seal with either the interior surface of a borehole or an interior surface of a downhole tubular. Temperature compensated element 20 is coupled to mandrel 5. Mandrel 5 may be included as part of a well tubular string (not shown). One having ordinary skill in the art with the benefit of this disclosure will understand that the well tubular string may be a drill string, casing string, tubing string, or any other suitable tubular member for use in a wellbore, and may have multiple components including, without limitation, tubulars, valves, or packers without deviating from the scope of this disclosure.

In at least one embodiment, temperature compensated element 20 may include housing 22, end ring 24, and swellable packer 26. Swellable packer 26 may include packer element 29. Swellable packer 26 may include a plurality of slats 28 at either end to, for example, form an extrusion barrier for packer element 29, couple swellable packer 26 to mandrel 5 and help prevent flow of the swellable packer material when in a swelled state. Swellable packer 26 may also include retainer ring 27 positioned to, for example, couple swellable packer 26 to mandrel 5 and to prevent any movement of swellable packer 26 along mandrel 5. One having ordinary skill in the art with benefit of this disclosure will understand that although the packer is described as a swellable packer throughout this disclosure, a non-swellable elastomeric packer element may be substituted without deviating from the scope of this disclosure.

Figure 4:
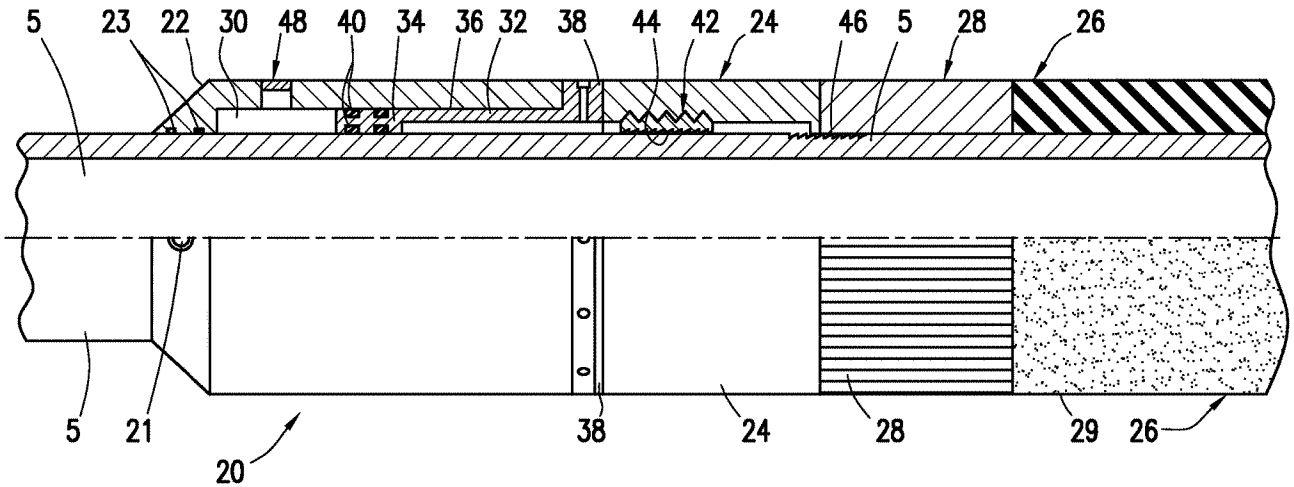
FIG. 4 is a partial cutaway view of a temperature compensated element consistent with at least one embodiment of the present disclosure.

Housing 22, end ring 24, and swellable packer 26 may be positioned about mandrel 5 and may be coupled thereto. As depicted in FIG. 4, housing 22 of temperature compensated element 20 may be coupled to mandrel 5 by set screw 21. One having ordinary skill in the art with the benefit of this disclosure will understand that housing 22 may be coupled to mandrel 5 by any suitable mechanism without deviating from the scope of this invention, including without limitation a set screw, shear wire, adhesive, etc.

Housing 22 may include a fluid expansion chamber 30. Fluid expansion chamber 30 may be filled with a thermally expanding fluid which may volumetrically expand in response to an increase in temperature caused by, for example, steam being passed through the interior of mandrel 5 or higher temperature hydrocarbons produced within the well. In some embodiments, the thermally expanding fluid may be selected to remain in a liquid phase throughout the temperatures and pressures to which it may be exposed during operation of temperature compensated element 20.

Figure 3:
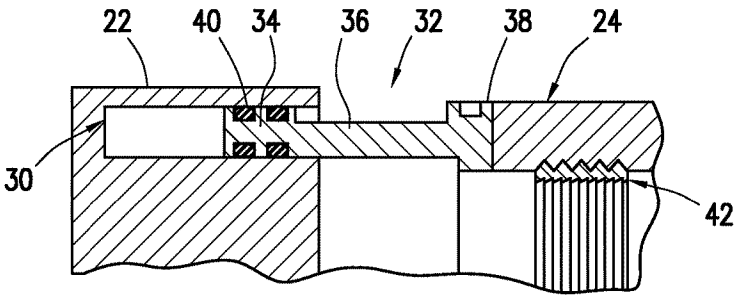
FIG. 3 is a partial quarter-section view of a piston of a temperature compensated element consistent with at least one embodiment of the present disclosure.

As depicted in FIGS. 3, 4, fluid expansion chamber 30 may be an annular space defined by the outer surface of mandrel 5, the inner surface of housing 22, and piston 32. Housing 22 may include at least one seal 23 to fluidly seal fluid expansion chamber 30 against mandrel 5. Piston 32 may include a piston head 34, a piston extension 36, and a piston operating body 38. Piston 32 may be positioned to slide within fluid expansion chamber 30 along the outer surface of mandrel 5 in response to a volumetric expansion of the fluid within fluid expansion chamber 30 as the fluid is heated. The fluid presses on piston head 34, causing a sliding displacement of piston 32 along mandrel 5. Piston head 34 may include one or more seals 40 positioned to prevent the fluid from escaping expansion chamber 30. As piston 32 moves, piston operating body 38 contacts end ring 24 and causes it to likewise slide along mandrel 5. The movement of end ring 24 towards swellable packer 26 causes a compression of swellable packer 26 along mandrel 5, which causes swellable packer 26 to mechanically expand in the wellbore.

As depicted in FIG. 4, end ring 24 may, in some embodiments, include a body lock ring 42 positioned within a recess in the interior surface of end ring 24. Body lock ring 42 may include teeth 44 on its interior positioned to interlock with wickers 46, here depicted as formed on the outer surface of mandrel. Body lock ring 42 may be positioned so that once piston 32 has moved in response to the thermal expansion of the fluid in the fluid expansion chamber 30, teeth 44 mesh with wickers 46 and prevent end ring 24 and piston 32 from returning to the run-in position from, for example, elastic reaction forces of swellable packer 26. One having ordinary skill in the art with the benefit of this disclosure will understand that body lock ring 42 may be positioned in other locations, such as piston extension 36, slats 28, etc. without deviating from the scope of this disclosure. Furthermore, one having ordinary skill in the art with the benefit of this disclosure will understand that wickers 46 may be formed in a separate member and not directly in the surface of mandrel 5. One having ordinary skill in the art with the benefit of this disclosure will understand that body lock ring 42 may be positioned along mandrel 5 with wickers positioned on end ring 24, piston extension 36, or slats 28.

Swellable packer 26 may be formed from a material which swells in response to the absorption of a swelling fluid, generally an oil or water-based fluid. The composition of the swelling fluid needed to activate swellable packer 26 may be selected with consideration of the intended use of the packer. For example, a packer designed to pack off an area of a well at once may be either oil or water-based and activated by a fluid pumped downhole. Alternatively, a delayed-use packer may be positioned in a well for long periods of time during, for example, hydrocarbon production. A swellable packer 26 which swells in response to an oil-based fluid would prematurely pack off the annulus. A swellable packer 26 which swells in response to water would therefore be used.

When swellable packer 26 is activated, the selected swelling fluid comes into contact with swellable packer 26 and may be absorbed by the material. In response to the absorption of swelling fluid, swellable packer 26 increases in volume and eventually contacts the wellbore, or the inner bore of the surrounding tubular. Continued swelling of swellable packer 26 forms a fluid seal between mandrel 5 and the wellbore or surrounding tubular. Pressure may then be applied from one or more ends of swellable packer 26.

Swellable packer 26 may likewise expand or contract in response to variations in temperature. For example, during a cycling steam stimulation (CSS) operation or steam-assisted gravity drainage (SAG-D) operation, high-pressure steam may be forced through a tool string. This steam will heat swellable packer 26 and may cause a thermal expansion in addition to any swelling expansion. When steam injection is halted, a conventional swellable packer may thermally contract, thereby potentially compromising the seal created by the swelling expansion of the swellable packer. As illustrated in FIG. 2 and previously described, swellable packer 26 may be mechanically expanded by the movement of end ring 24 as the thermally expanding fluid in fluid expansion chamber 30 is heated. This mechanical expansion may, for example, compensate for any thermal contraction as swellable packer 26 cools.

In some embodiments, housing 22 may include a pressure relief apparatus to prevent damage to temperature compensated element 20 caused by too much pressure within fluid expansion chamber 30. The pressure relief apparatus may be positioned to, at a selected threshold pressure, release at least some thermally expanding fluid from fluid expansion chamber 30 into, for example, the surrounding wellbore. In some embodiments, the pressure relief apparatus may include, for example and without limitation, a relief or safety valve, blowoff valve, or a rupture disc such as rupture disc 48 as depicted in FIG. 4. Rupture disc 48 may be positioned in the wall of fluid expansion chamber 30. Rupture disc 48 may be calibrated to mechanically fail once the fluid in fluid expansion chamber 30 reaches a selected threshold pressure to, for example, prevent damage to temperature compensated element 20 or swellable packer 26. When rupture disc 48 fails, fluid from fluid expansion chamber 30 may flow into the surrounding wellbore. Rupture disc 48 may be calibrated by varying, for example, its diameter, thickness, and by placing weakening grooves in its structure.

Figure 5:
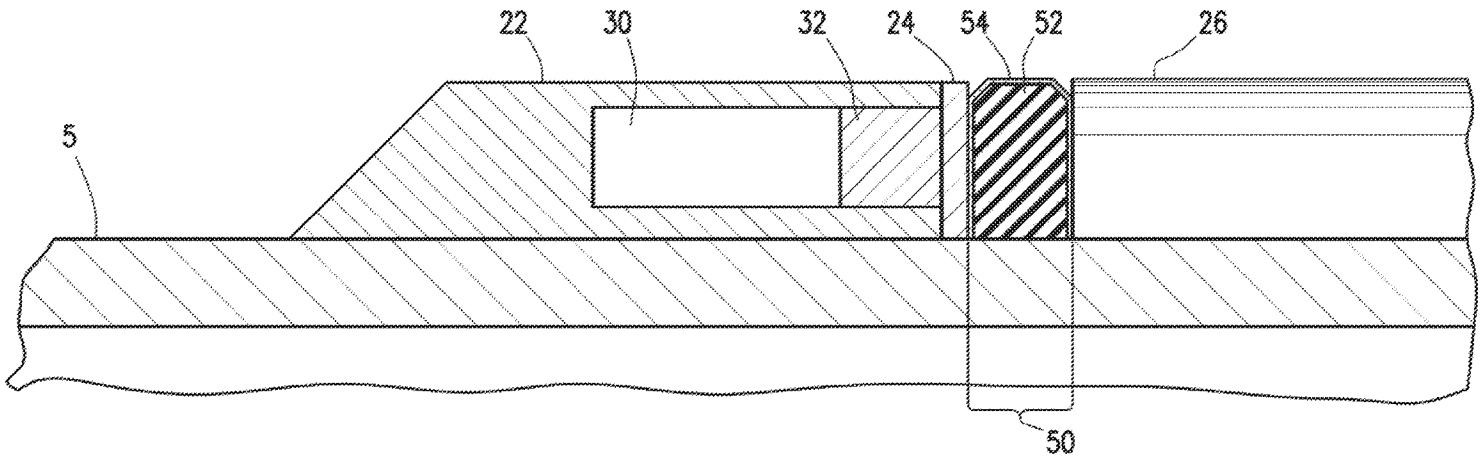
FIG. 5 is a cross section of a temperature compensated element consistent with at least one embodiment of the present disclosure.
Figure 6:
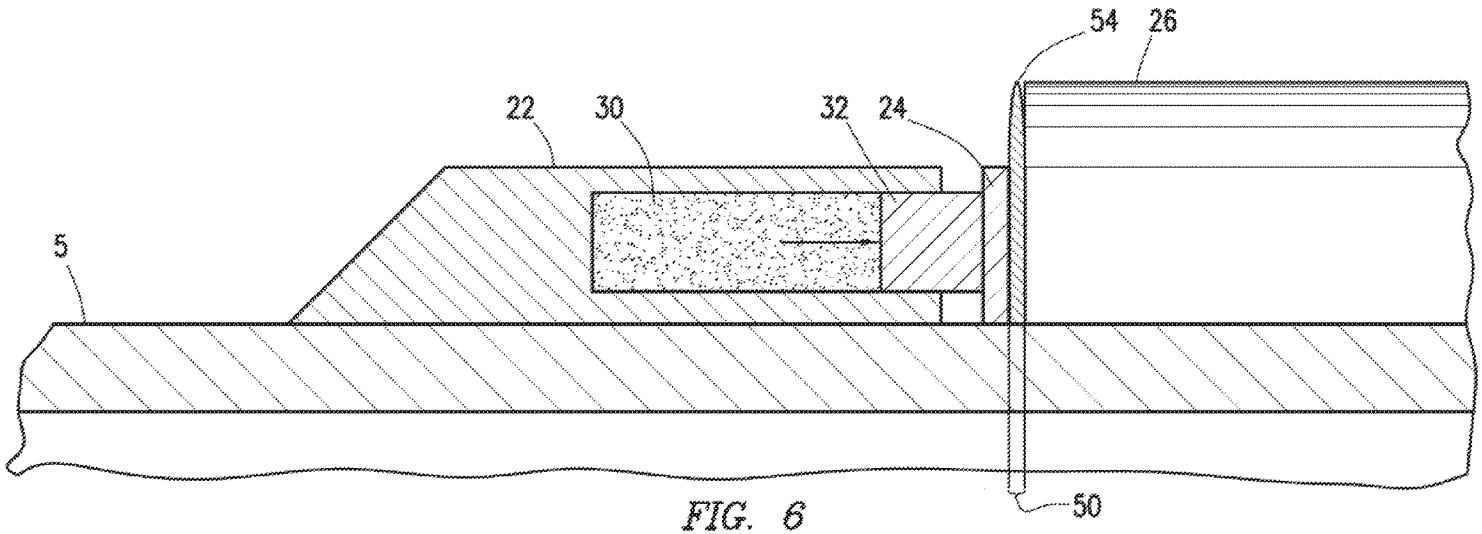
FIG. 6 is a cross section of the temperature compensated element of FIG. 5.

In some embodiments, temperature compensated element 20 may include a backup system to, for example and without limitation, prevent or delay the extension of piston 32 while in the wellbore. In some embodiments, as depicted in FIGS. 5, 6, temperature compensated element 20 may include at least one backup ring 50. Backup ring 50 may, in some embodiments, be coupled between end ring 24 and swellable packer 26. In some embodiments, at least a part of backup ring 50 may include degradable ring 52. Degradable ring 52 may be formed from a material selected to be initially solid and to degrade when exposed to one or more selected conditions. For example and without limitation, degradable ring 52 may be adapted to dissolve when exposed to, for example and without limitation, high temperature, oil or water based fluids, acidic or basic fluids, or by chemical reaction with a dissolving agent introduced into the wellbore. In some embodiments, degradable ring 52 may be formed from a material which requires a selected amount of time to dissolve when exposed to the selected conditions. For example and without limitation, in some embodiments, degradable ring 52 may be formed from PLA.

In some embodiments, as depicted in FIG. 5, degradable ring 52 may be coupled to mandrel 5. Degradable ring 52 may be positioned to prevent the extension of end ring 24 before degradable ring 52 at least partially dissolves. Once degradable ring 52 sufficiently dissolves, end ring 24 may be extended as discussed herein as depicted in FIG. 6.

In some embodiments, as depicted in FIG. 5, degradable ring 52 may be contained within encapsulation 54. In some embodiments, encapsulation 54 may surround degradable ring 52 to, for example and without limitation, prevent damage to degradable ring 52 while allowing fluid contact between degradable ring 52 and the wellbore. In some embodiments, encapsulation 54 may be, for example and without limitation, formed as a metal mesh. In some embodiments, encapsulation 54 may be formed from a material selected such that encapsulation 54 does not interfere with the extension of end ring 24. In some embodiments, encapsulation 54 may be adapted to be crushed between end ring 24 and swellable packer 26 as depicted in FIG. 6.

One having ordinary skill in the art with the benefit of this disclosure will understand that backup ring 50 may be used in conjunction with any mechanism configured to compress a swellable packer 26 including, for example and without limitation, a spring positioned to extend end ring 24. In such an embodiment, an end ring is biased to compress a swellable packer as discussed hereinabove, but is prevented from moving by backup ring 50 until degradable ring 52 has sufficiently dissolved.

In order to understand the operation of a temperature compensated element as described herein, an exemplary operation thereof will now be described. Although this example describes only a cycling steam stimulation operation, one having ordinary skill in the art with the benefit of this disclosure will understand that the example is not intended to limit use of the temperature compensated element in any way to one particular operation, and the temperature compensated element described may be used in other operations without deviating from the scope of this disclosure.

In a CSS operation, as understood in the art, high-pressure steam may be injected into a formation through a downhole tubular. The steam heats the formation and any hydrocarbons contained therein to, for example, reduce viscosity thereof and thereby allow a higher flow rate. Once the desired heating has been effected, the steam injection is halted, and hydrocarbons may flow through the tubular more rapidly than before the CSS operation. Cycles of heating and production may be repeated multiple times.

Temperature compensated element 20 as depicted in FIG. 1 may be included as a part of the downhole tubular assembly (not shown). In one embodiment, the downhole tubular assembly may be a string of production casing. Temperature compensated element 20 may be run-into the wellbore (not shown) in the run-in position depicted in FIG. 1. Once in position in the wellbore, fluids in the wellbore may be absorbed by swellable packer 26. Swellable packer 26 volumetrically expands as swelling fluids are absorbed, causing swellable packer 26 to form a seal against the surrounding wellbore. Temperature compensated element 20 may be left to expand for a period of time before enhanced recovery operations commence, i.e. during primary and/or secondary recovery operations. During this time, swellable packer 26 may operate as a normal swellable packer in the wellbore to isolate the formation on one side of temperature compensated element 20 from the wellbore on the other side of temperature compensated element 20.

At some point it may be decided to run a CSS operation. At this time, steam may be injected through the downhole tubular assembly including through mandrel 5 of temperature compensated element 20. The hot steam causes the thermally expanding fluid in fluid expansion chamber 30 to expand, forcing piston 32 and end ring 24 along mandrel 5 as previously discussed. Swellable packer 26 may be compressed along mandrel 5. This deformation causes swellable packer 26 to increase in radius and/or press more firmly against the surrounding wellbore. Once the desired expansion has been achieved, body lock ring 42 engages wickers 46, thereby locking swellable packer 26 in the actuated position depicted in FIG. 2. When steam injection is halted, body lock ring 42 maintains the actuated position even as fluid in the fluid expansion chamber cools.

In some embodiments, temperature compensated element 20 may be heated by fluids within the formation naturally or artificially heated in the formation. For example, in a SAG-D operation as understood in the art, a temperature compensated element 20 located within the production well may be heated by the hydrocarbons heated by the steam injection well. In other embodiments, produced hydrocarbons may naturally exist at a higher temperature than the wellbore when drilled. Therefore, the production of the hydrocarbons themselves may serve to heat the fluid within temperature compensated element 20.

In embodiments utilizing a backup ring 50 as depicted in FIG. 5, although the pressure in fluid expansion chamber 30 has risen, backup ring 50 may prevent unwanted or premature extension of end ring 24. Only once degradable ring 52 has sufficiently dissolved, by the application of a dissolving agent, fluid, or heat as determined by the composition of degradable ring 52, may end ring 24 extend.

In some embodiments, rupture disc 48 may be included in the wall of housing 22, and may be calibrated such that the pressure necessary to achieve full actuation will cause rupture disc 48 to fail, allowing the pressurized fluid within fluid expansion chamber 30 to flow into the surrounding wellbore, relieving pressure on piston 32.

In some embodiments of the invention, the fluid in fluid expansion chamber 30 may be heated to between 200° F. and 900° F. In other embodiments, the fluid in fluid expansion chamber 30 may be heated to between 200° F. and 650° F. In some embodiments, the pressure of fluid in fluid expansion chamber 30 may be increased to between 500 and 4000 psi. In other embodiments, the pressure of fluid in fluid expansion chamber 30 may be increased to between 500 and 2200 psi.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A temperature compensated element comprising:

a mandrel, the mandrel being generally tubular and having a central axis and an exterior cylindrical surface;

a housing coupled to the mandrel, the housing defining a fluid expansion chamber between an inner wall of the housing and the exterior cylindrical surface of the mandrel;

a piston positioned about the mandrel, the piston having a piston head positioned within the fluid expansion chamber and adapted to slide along the mandrel, the piston head forming a seal against the housing and the mandrel to enclose the fluid expansion chamber;

a thermally expanding fluid positioned within the fluid expansion chamber;

an end ring positioned about the mandrel, the end ring coupled to the piston, the end ring adapted to slide along the mandrel in response to a sliding of the piston;

a degradable ring coupled to the mandrel, the degradable ring positioned adjacent to the end ring and adapted to prevent sliding of the end ring before the degradable ring has at least partially dissolved; and a packer including a packer element coupled to the exterior cylindrical surface of the mandrel, the packer having a first end and a second end, the first end adapted to slide along the mandrel in response to a sliding of the end ring, and the second end fixedly coupled to the mandrel, so that a sliding of the first end of the packer toward the second end causes the packer element to decrease in length and increase in radius.

2. The temperature compensated element of claim 1, further comprising:

a body lock ring adapted to slide along the mandrel in response to a sliding of the piston, the body lock ring having at least one tooth; and at least one wicker coupled to the mandrel adapted to engage the at least one tooth of the body lock ring when the piston, end ring, and the first end of the packer have traveled a selected distance along the mandrel.

3. The temperature compensated element of claim 1, further comprising a pressure relief apparatus adapted to, at a selected threshold pressure, allow at least some of the thermally expanding fluid to flow out from the fluid expansion chamber.

4. The temperature compensated element of claim 3, wherein the pressure relief apparatus comprises a rupture disc positioned in the wall of the housing, the rupture disc adapted to mechanically fail when the pressure of the thermally expanding fluid positioned within the fluid expansion chamber reaches the selected threshold pressure.

5. The temperature compensated element of claim 3, wherein the pressure relief apparatus comprises one or more of a relief valve, safety valve, or blow off valve.

6. The temperature compensated element of claim 1, wherein the packer element is formed from a swellable material.

7. The temperature compensated element of claim 1, wherein the packer element is formed from an elastomeric material.

8. The temperature compensated element of claim 1, wherein the packer further comprises a plurality of slats positioned at the first end and the second end of the packer element adapted to form an extrusion barrier for the packer element.

9. The temperature compensated element of claim 1, wherein the degradable ring is formed from a material adapted to dissolve in the presence of one or more of an elevated temperature or a fluid or chemical selected to dissolve the degradable ring.

10. The temperature compensated element of claim 1, wherein the degradable ring further comprises an encapsulation adapted to at least partially surround the degradable ring.

11. A method of isolating a section of wellbore comprising:

providing a temperature compensated element, the temperature compensated element including:

a mandrel, the mandrel being generally tubular and having a central axis and an exterior cylindrical surface;

a housing coupled to the mandrel, the housing defining a fluid expansion chamber between an inner wall of the housing and the exterior cylindrical surface of the mandrel;

a piston positioned about the mandrel, the piston having a piston head positioned within the fluid expansion chamber and adapted to slide along the mandrel, the piston head forming a seal against the housing and the mandrel to enclose the fluid expansion chamber;

a thermally expanding fluid positioned within the fluid expansion chamber;

an end ring positioned about the mandrel, the end ring coupled to the piston, the end ring adapted to slide along the mandrel in response to a sliding of the piston;

a degradable ring coupled to the mandrel, the degradable ring positioned adjacent to the end ring and adapted to prevent sliding of the end ring before the degradable ring has at least partially dissolved; and a packer including a packer element coupled to the exterior cylindrical surface of the mandrel, the packer having a first end and a second end, the first end adapted to slide along the mandrel in response to a sliding of the end ring, and the second end fixedly coupled to the mandrel;

coupling the temperature compensated element to a downhole tubular assembly;

running the downhole tubular assembly into a wellbore;

heating the downhole tubular assembly;

dissolving the degradable ring;

expanding the thermally expanding fluid, causing the piston, end ring, and first end of the packer to move along mandrel so that the packer element decreases in length and increases in radius, defining an actuated position; and contacting the wellbore with the outer surface of the packer.

12. The method of claim 11, wherein the temperature compensated element further comprises:

a body lock ring adapted to slide along the mandrel in response to a sliding of the piston, the body lock ring having at least one tooth; and at least one wicker coupled to the mandrel adapted to engage the at least one tooth of the body lock ring when the piston, end ring, and the first end of the packer have traveled a selected distance along the mandrel;

and the method further comprises:

locking the packer in the actuated position.

13. The method of claim 11, wherein the temperature compensated element further comprises a pressure relief apparatus adapted to, at a selected threshold pressure, allow at least some of the thermally expanding fluid to flow out from the fluid expansion chamber.

14. The method of claim 13, wherein the pressure release apparatus comprises a rupture disc positioned in the wall of the housing, the rupture disc adapted to mechanically fail when the pressure of the thermally expanding fluid positioned within the fluid expansion chamber reaches a selected threshold pressure.

15. The method of claim 13, wherein the pressure relief apparatus comprises one or more of a relief valve, safety valve, or blow off valve.

16. The method of claim 11, wherein the heating operation comprises injecting steam into the downhole tubular.

17. The method of claim 11, wherein the heating operation comprises flowing a higher temperature fluid through the downhole tubular.

18. The method of claim 11, wherein the thermally expanding fluid is heated to between 200° F. and 900° F.

19. The method of claim 11, wherein the thermally expanding fluid reaches a pressure of between 500 psi and 4000 psi.

20. The method of claim 11, wherein the packer element is formed from a swellable material, and the method further comprises swelling the packer element with swelling fluids in the wellbore.

* * * * *